United States Patent [19]

Coursaut-Durand

[11] 4,084,719

[45] Apr. 18, 1978

[54] SECURITY CLOSURES

[76] Inventor: Henri Coursaut-Durand, Mercurey, Givry, France, 71640

[21] Appl. No.: 774,169

[22] Filed: Mar. 3, 1977

[30] Foreign Application Priority Data

Mar. 16, 1976 France ..... 76 08573
Sep. 23, 1976 France ..... 76 29177

[51] Int. Cl.[2] ..... B65D 41/58
[52] U.S. Cl. ..... 215/256; 215/257
[58] Field of Search ..... 215/251, 254, 255, 256, 215/257; 220/255, 257

[56] References Cited

U.S. PATENT DOCUMENTS

| | | | |
|---|---|---|---|
| 2,068,444 | 1/1937 | Breckenridge | 215/254 |
| 2,227,880 | 1/1941 | Dodge | 215/257 |
| 3,080,991 | 3/1963 | Fox | 215/257 |

FOREIGN PATENT DOCUMENTS

| | | | |
|---|---|---|---|
| 2,260,509 | 9/1975 | France | 215/254 |
| 676,480 | 11/1964 | Italy | 215/254 |

*Primary Examiner*—Donald F. Norton
*Attorney, Agent, or Firm*—Dowell & Dowell

[57] ABSTRACT

A security closure for a container, comprises a capsule, and a stopper including a tearstrip having a free end which in use passes through an opening in the capsule, the opening having a width greater than its height. The capsule has two lines of weakness which are aligned with the longitudinal edges of the tearstrip.

8 Claims, 6 Drawing Figures

SECURITY CLOSURES

The present invention relates to improvements in security closures.

Security closures are closures which cannot be opened without the fact being immediately apparent and usually incorporate a tearstrip which has its edges joined to the body of the closure by lines of weakness, or some similar arrangement.

Originally such tearstrips were discontinuous to enable them to be gripped. This meant that a fingernail had to be slipped under one of the accessible ends of the tearstrip, which was then gripped and pulled to tear off the tearstrip. In some cases, the end of the tearstrip was provided with a grip portion, usually of a plastics material, so that it could be gripped more easily. Such arrangements have two disadvantages. Firstly, the user can hurt himself when getting hold of the tearstrip. Secondly, the tearstrip may not tear along the lines of weakness, and only part of it may tear off. Should this happen, the remainder of the strip has to be removed and this can be a long and difficult business.

Composite closures have also been produced, including a stopper for closing the container and a metal capsule which is fitted over the stopper. The stopper has a tearstrip, with a free end which passes through a slot in the capsule so that it can be gripped and pulled to tear off the tearstrip and also tear through the capsule.

A closure of this type is described in German Patent Specification No. 811,556. However, the device described in that specification cannot be produced industrially, as no means are provided for passing the end of the tearstrip through the slot in the capsule.

In accordance with the present invention, there is provided a security closure for a container, comprising a capsule, and a stopper including a tearstrip having a free end which in use passes through an opening in the capsule, the opening having a width greater than its height, wherein the capsule has two lines of weakness which are aligned with the longitudinal edges of the tearstrip.

Figure 1:
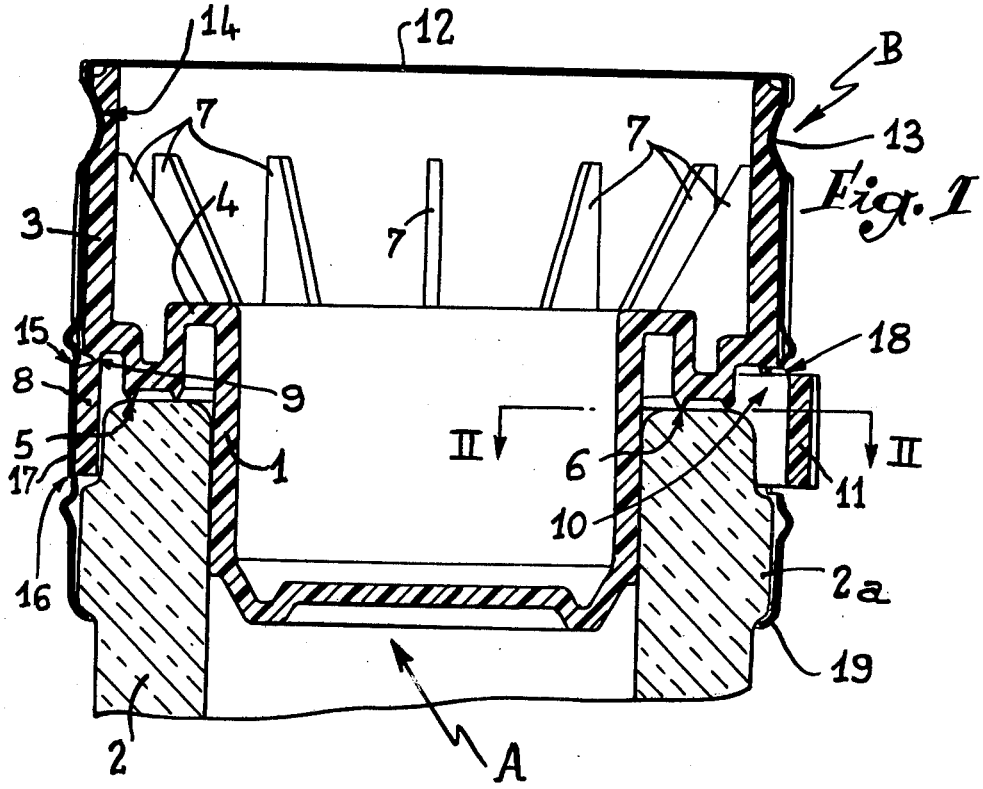
Figure 3:
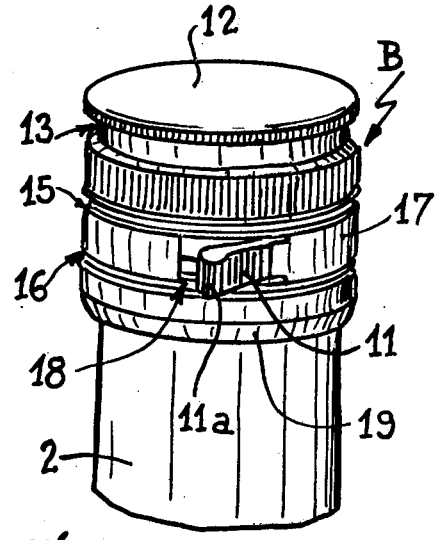
Figure 2:
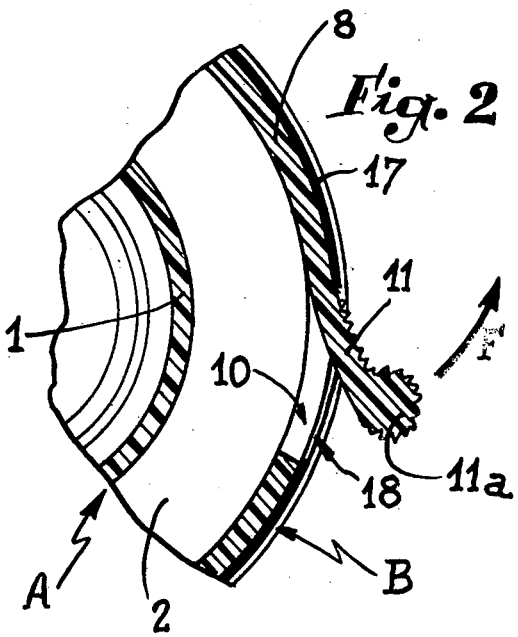
Figure 5:
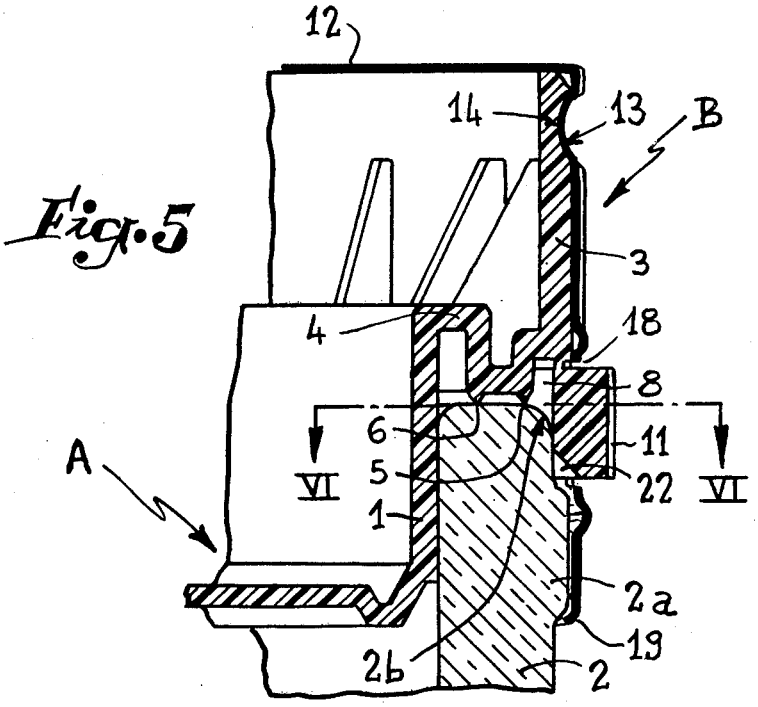
Figure 4:
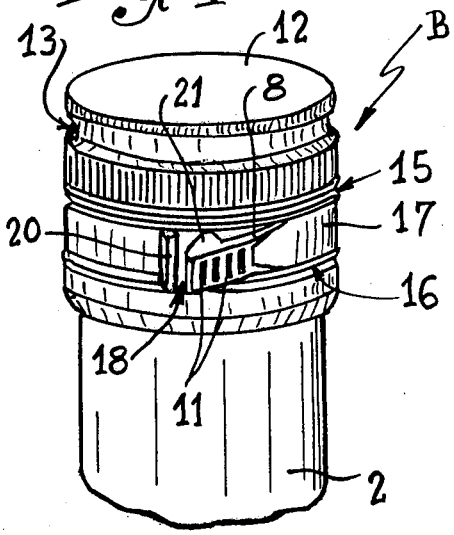
Figure 6:
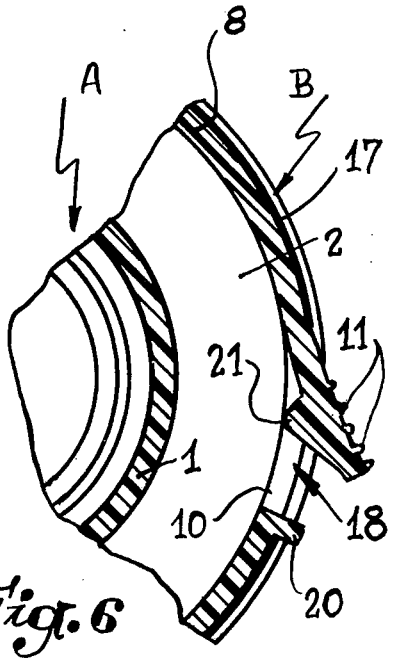

Two forms of security closures in accordance with the invention will now be described, by way of example, with reference to the accompanying drawings, in which:

FIG. 1 is a longitudinal cross-section through one form of security closure fitted to the neck of a bottle, FIG. 2 is a cross-section taken on the line II—II in FIG. 1, FIG. 3 is a perspective view, to a smaller scale, of the neck of the bottle fitted with the closure of FIG. 1, FIG. 4 is a view similar to that of FIG. 3, but showing the other form of closure, FIG. 5 is a partial longitudinal cross-section through the closure shown in FIG. 4, and FIG. 6 is a partial cross-section taken on the line VI—VI in FIG. 5.

Referring to FIG. 1, the closure comprises a stopper A and a capsule B fitting over the stopper.

The stopper A is made of a synthetic material such as a suitable plastics, for example polyethylene, and comprises a body section 1 which engages in the opening in the neck 2 of the bottle or other container and a head section 3 which lies above the top of the neck. The stopper is hollow, so that the head section consists only of a cylindrical wall with an inside diameter which is advantageously equal to the outside diameter of the top part of the neck 2. A horizontal collar 4 joins the body section 1 to the lower portion of the cylindrical wall which forms the head section 3. It will be noted that this collar is of double-U form, so that the bottom of the head section 3 is located above the plane of the top of the neck 2. Circular bands 5 and 6 are provided on the inside face of the collar 4, so that the collar bears on the neck through these bands. The stopper A is rigidified by triangular reinforcing elements 7 formed on the inside surface of the head section.

The bottom of the wall of the head section 3 of the stopper A is joined to one edge of a downwardly extending strip 8 at a line 9 of reduced thickness, the other edge of the strip 8 being a free edge. It will be noted that this strip 8 is slightly offset outwardly, its inside surface co-operating with the part of the neck situated above the ring 2*a* . The thickness of the strip 8 is preferably such that its outer periphery has a diameter which is slightly greater than the outer diameter of the wall which forms the head section 3 of the stopper. There is a short gap 10 (FIG. 2) in the strip 8, so that its ends are clearly separated from one another. One of these ends in a free end provided with a grip portion in the form of a tongue 11 (FIG. 2) having a widened end portion 11*a*. The tongue 11 is formed with vertical ridges, so that it may be gripped easily. The other end of the strip 8 is approximately aligned with the cylindrical wall which forms the head section 3. The mould is so designed that the tongue 11 is outwardly offset relative to, or projects outwardly from, the perimeter of the stopper, as clearly shown in FIG. 2.

The capsule B is made from a film of a malleable metal such as aluminium, and is in the form of a cylindrical sleeve closed at one end 12. The capsule is formed with a peripheral depression 13 which can engage in a groove 14 which runs around the upper portion of the head section 3. The capsule B has two lines 15 and 16 of reduced thickness which are respectively located opposite the line 9 on the stopper A and opposite the lower, free edge of the strip 8. These two lines define a "warranty" strip 17, which is interrupted to form a side opening 18 which has a width in the circumferential direction greater than its height.

It will be readily appreciated that the stopper A can be elastically or resiliently sprung into the capsule B, the stopper and capsule being aligned so that when assembled together the tongue 11 passes through the opening 18, by virtue of its own resilience, to project outwardly.

The assembly is automatically located on the neck of a bottle, and the bottom of the capsule is crimped under the ring 2*a* of the neck 2, as shown at 19.

When the bottle is to be opened, it is only necessary to pull on the tongue 11, in the direction shown by the arrow F (FIG. 2), which tears the strips 17 and 8, simultaneously, so that the stopper, which is still in the upper portion of the capsule, can be removed from the bottle.

It will be appreciated that this operation is made very simple by the presence of the tongue 11, and by the strip 8 which acts as a guide, to ensure that the capsule tears along the lines of weakness 15 and 16.

In the modified form of the closure shown in FIGS. 4 to 6, the end of the strip 8 opposite the grip portion 11 is formed with a hook 20 which extends radially outwardly and engages one end of the strip 17. Thus the hook 20 passes through the side opening 18 in the capsule B, as can best be seen in FIGS. 4 and 6, to engage one edge of the opening.

The grip portion 11 of the strip 8 is formed with a stud 21 of cusp shape on its inside surface. Before the closure is fitted to a bottle, this stud passes through the thickness of the strip 8 to project into the inside of the device, so that the grip portion 11 is virtually aligned with the generally tubular shape of the tearstrip 8. As can be seen in FIG. 5, the stud comprises an inclined portion 22 which is directed downwards.

It will be readily appreciated that when the stopper and the capsule are fitted together the hook 20 engages one edge of the opening 18 while the grip portion 11 is automatically located in the opening 18 by virtue of its own resilience. As the closure device is fitted to a bottle, the inclined portion 22 engages the rounded edge **2*b* of the upper edge of the neck 2, so that the grip portion 11 is progressively pushed outwardly to the position shown in FIG. 6, in which it projects through the opening 18** so that it can easily be gripped.

The above-described closures have a stopper and a security capsule including a "warranty" strip which can easily be torn away to provide access to the contents of the container to which the closure is fitted, without any risk of hurting the user and without increasing the cost of the article in question.

The above-described forms of security closure do not involve increased costs, even though they have tongues which are especially easy to grip, and even though complete tearing of the "warranty" strip of the capsule is ensured. In particular, in the second form of closure the tearing is facilitated by the co-operation of the hook 20 and the corresponding edge of the strip 17, which prevents the capsule turning relative to the stopper while the strip 17 is being torn.

I claim:

1. A security closure for a container having a neck with an outer surface and having an opening through the neck, comprising a capsule and a stopper within said capsule, said stopper being made of plastic material and shaped to close the opening in the neck, and the stopper including a cylindrical head portion overlying the outer surface of the neck of the container and including a depending integrally formed tearstrip having opposed longitudinal edges extending circumferentially around said outer surface of the container neck, the tearstrip joining the head portion along a line of reduced material thickness, and the tearstrip having one end portion which is free and manually grippable; and said capsule covering said stopper and gripping said container neck, the capsule having an opening of circumferential width greater than its height, said end portion of said tearstrip projecting through the opening outwardly of said capsule, and the capsule having two circumferential lines of weakness which are aligned with said longitudinal edges of said tearstrip.

2. A closure according to claim 1, wherein said end portion of the said tearstrip is outwardly offset to protrude through the opening in the capsule.

3. A closure according to claim 1, wherein said stopper is made of a flexible plastic material, and said capsule is made of thin malleable metal.

4. A closure according to claim 1, wherein the other end of said tearstrip opposite said free end portion is formed with an outwardly extending hook which engages an edge of said opening in said capsule, whereby sliding of said tearstrip relative to said capsule is prevented when the tearstrip is removed.

5. A closure according to claim 1, wherein said free end portion of said tearstrip is formed with an inwardly facing stud which is arranged to bear on said outer surface of said neck of said container, whereby said free end portion is urged through said opening in said capsule so that the free end can readily be gripped.

6. A closure according to claim 5, wherein said inwardly facing stud includes a downwardly and outwardly inclined portion disposed for engagement with said neck of said container to push said end portion of the tearstrip outwardly when the closure is fitted to the container.

7. A closure according to claim 1, wherein said free end portion of said tearstrip includes ribs to provide a grippable portion.

8. A closure according to claim 1, wherein one of said longitudinal edges of said tearstrip is a free edge of said stopper and lies below the other longitudinal edge comprising said line of reduced material thickness around said stopper.

* * * * *